US009766023B2

(12) United States Patent
Schatz-Knecht

(10) Patent No.: US 9,766,023 B2
(45) Date of Patent: Sep. 19, 2017

(54) HEAT EXCHANGER IN A HOUSING

(71) Applicant: Modine Manufacturing Company, Racine, WI (US)

(72) Inventor: Wolfgang Schatz-Knecht, Walddorfhäslach (DE)

(73) Assignee: Modine Manufacturing Company, Racine, WI (US)

( * ) Notice: Subject to any disclaimer, the term of this patent is extended or adjusted under 35 U.S.C. 154(b) by 471 days.

(21) Appl. No.: 14/312,933

(22) Filed: Jun. 24, 2014

(65) Prior Publication Data

US 2014/0374073 A1 Dec. 25, 2014

(30) Foreign Application Priority Data

Jun. 25, 2013 (DE) ..... 10 2013 010 537

(51) Int. Cl.
*F28D 7/10* (2006.01)
*F28F 9/00* (2006.01)
(Continued)

(52) U.S. Cl.
CPC ..... *F28F 9/001* (2013.01); *F28D 7/1653* (2013.01); *F28F 9/0219* (2013.01); *F28F 21/067* (2013.01); *F28D 2021/0082* (2013.01)

(58) Field of Classification Search
CPC ..... F28F 9/001; F28F 21/067; F28F 9/0219; F28D 7/1653; F28D 2021/0082
(Continued)

(56) References Cited

U.S. PATENT DOCUMENTS 2,611,586 A * 9/1952 Collins ..... F28F 1/42 165/140
4,394,141 A * 7/1983 Cadars ..... F28F 9/0226 165/148
(Continued)

FOREIGN PATENT DOCUMENTS

CN 101586920 11/2009
CN 102287906 12/2011
(Continued)

OTHER PUBLICATIONS

First Office Action from The State Intellectual Property Office of the People's Republic of China for Application No. 201410283818.9 dated May 2, 2017 (6 pages, which includes a Statement of Relevance).

*Primary Examiner* — Len Tran
*Assistant Examiner* — Claire Rojohn, III
(74) *Attorney, Agent, or Firm* — Michael Best & Friedrich LLP

(57) ABSTRACT

A heat exchanger including a stack of tubes, a cover plate, and a housing in which the stack of tubes is arranged. The housing includes first, second, and third adjacent housing sides having a respective first, second, and third housing openings each having a edge around the respective housing opening. The second housing opening is closed by the edge of the cover plate on the edge of the second housing opening. The housing further includes first and second exposed struts. The first exposed strut is positioned between the first and the second housing openings and the second exposed strut is positioned between the second and the third housing openings, and a first side of an edge of the cover plate is fastened to the first exposed strut and a second side of the edge of the cover plate is fasted to the second exposed strut.

20 Claims, 2 Drawing Sheets

(51) Int. Cl.

| | |
|---|---|
| ***F28F 9/02*** | (2006.01) |
| ***F28F 21/06*** | (2006.01) |
| ***F28D 7/16*** | (2006.01) |
| *F28D 21/00* | (2006.01) |

(58) Field of Classification Search
USPC ..... 165/151, 157
See application file for complete search history.

(56) References Cited

U.S. PATENT DOCUMENTS

| | | | | |
|---|---|---|---|---|
| 8,286,615 | B2 * | 10/2012 | Dehnen | F02B 29/0462 123/184.21 |
| 8,695,574 | B2 | 4/2014 | Nguyen | |
| 8,701,604 | B2 * | 4/2014 | Keerl | F02B 29/0462 123/41.08 |
| 2006/0278377 | A1 * | 12/2006 | Martins | F02B 29/0412 165/140 |
| 2007/0175617 | A1 * | 8/2007 | Brost | F02B 29/0462 165/149 |
| 2007/0181105 | A1 * | 8/2007 | Bazika | F02B 29/0462 123/563 |
| 2009/0056922 | A1 | 3/2009 | Hemminger et al. | |
| 2009/0260787 | A1 | 10/2009 | Kalbacher | |
| 2010/0096101 | A1 * | 4/2010 | Braun | F02B 29/0462 165/41 |
| 2011/0017425 | A1 * | 1/2011 | Bourgoin | F02B 29/0418 165/51 |
| 2011/0056652 | A1 * | 3/2011 | Neher | F28D 7/1684 165/81 |
| 2012/0210986 | A1 * | 8/2012 | Ghiani | F02B 29/0462 123/542 |
| 2013/0133866 | A1 * | 5/2013 | Kinder | F28D 9/0056 165/151 |
| 2014/0130764 | A1 * | 5/2014 | Saumweber | F02B 29/045 123/184.21 |
| 2014/0138071 | A1 * | 5/2014 | Odillard | F02B 29/0475 165/164 |
| 2014/0231054 | A1 * | 8/2014 | Martins | F02B 29/0462 165/166 |
| 2014/0373517 | A1 * | 12/2014 | Sweet | F28F 9/02 60/324 |
| 2015/0083091 | A1 * | 3/2015 | Fehrenbach | F28D 7/1692 123/542 |

FOREIGN PATENT DOCUMENTS

| | | | |
|---|---|---|---|
| DE | 102006018217 | A1 | 10/2007 |
| DE | 102007033148 | A1 | 1/2008 |
| JP | 2005-274010 | | 10/2005 |
| JP | 2005-308303 | | 11/2005 |
| WO | 2013149087 | A1 | 3/2013 |
| WO | 2013162822 | A1 | 3/2013 |

* cited by examiner

HEAT EXCHANGER IN A HOUSING

CROSS REFERENCE TO RELATED APPLICATIONS

This application claims priority to German Patent Application No. 10 2013 010 537 filed Jun. 25, 2013, the entire contents of which are hereby incorporated by reference herein.

BACKGROUND OF THE INVENTION

The invention relates to a heat exchanger in a housing, constructed from at least one stack of tubes with fins arranged in between and a cover plate.

Such heat exchangers are often used to cool charge air or exhaust or a mixture of charge air and exhaust and have been increasingly proposed in recent years. In most or in many cases the housing is formed from the intake tube of an internal combustion engine. The intake tube must therefore have a certain design size so that the required cooling power can be installed in it.

DE 10 2009 055 715 A1 shows such an example. In this publication an air or exhaust inlet is designed in one piece with the intake tube, i.e., integrated in it, which is practicable. Only two adjacent intake tube openings are therefore proposed in this publication. The heat exchanger there does not consist of a stack of plates and fins with a cover plate, but of flat tubes and fins, collection boxes being arranged on the open front ends of the flat tubes, which require quite a bit of space.

SUMMARY

The task of the invention is to propose an advantageous alternative in which the heat exchanger with its housing is a separate compact unit, arranged according to the circumstances, in an engine compartment and can be connected, for example, with a much smaller intake tube.

This task is solved according to the invention with a heat exchanger in a housing as described herein.

An aspect of the invention proposes that the housing is a cage-like cast structure having two exposed struts, each of the struts is between the adjacent housing openings, in which case the cover plate is fastened with one side to one strut and with its roughly parallel other side to the other strut.

Free struts according to the present invention are rod-like connections of two opposite housing sides, like a rod in the cage-like housing. A cross section of the struts is roughly Z-shaped. It has two steps. They are referred to as exposed, because they are situated around two of the housing openings.

A situation can be achieved through the invention with its special housing structure made of aluminum casting that one can get by with the same housing structure without significant changes and therefore costly different design concepts.

According to one design concept it can be beneficial to form the inlet collection box not from actually cheaper plastic, but from metal, for example, sheet metal or from an aluminum casting because of the extremely hot exhausts. The outlet collection box, which is exposed to much lower temperatures, can be made of plastic in each case and is fastened mechanically by fastening eyes or the like. Both are feasible with the same housing design.

Another design easily permits two mechanically fastened plastic boxes.

According to another design concept two metallic collection boxes can also be inserted just as easily and fastened, for example, by welding to the housing structure without changing the housing structure.

A corresponding and quite noteworthy feature is seen in the fact that the mentioned fastening eyes are arranged distributed on a cover plate. These eyes, which can be designed similar to nuts to accommodate screws, are to be brazed onto the cover plate during brazing of the stack. In such cases in which the fastening eyes are not required, they can be simply left out. In these cases two metallic collection boxes can be welded onto the edges of the second and third housing openings.

Various features of the invention are apparent from the following description of a practical example, which is done with reference to the appended drawings.

DETAILED DESCRIPTION

Figure 1:
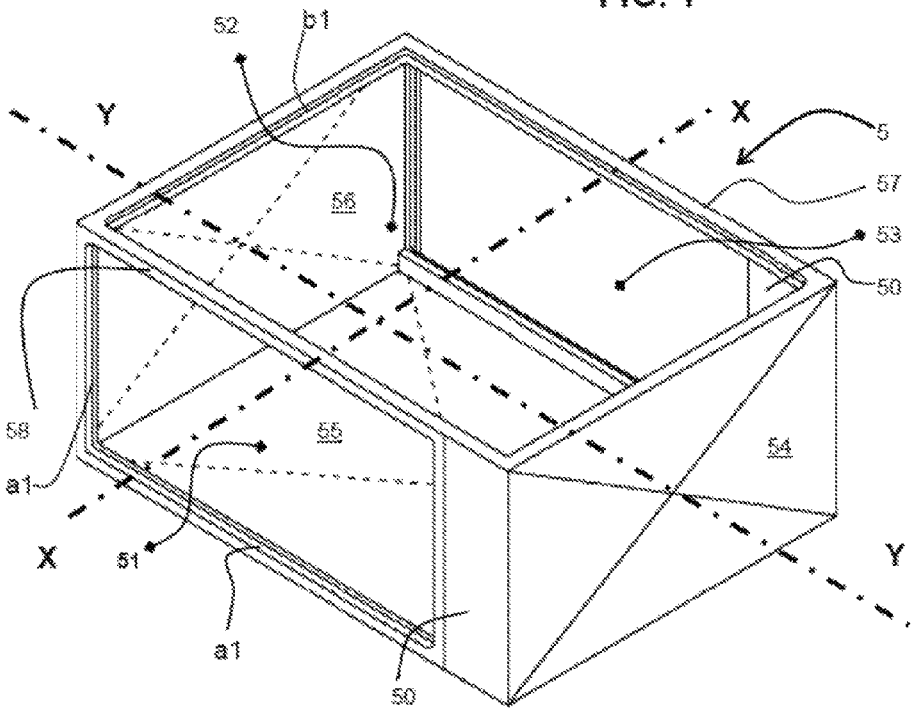
FIG. 1 shows the housing of the heat exchanger as an individual part in a perspective view.

As can be deduced from FIG. 1, a housing 5 is designed roughly cuboid or also cubic. The illustrated housing 5 is a one-part, cage-like the cast structure made of aluminum.

Three adjacent housing openings 51, 52, 53, which are arranged in three adjacent housing sides, extend in the illustrated embodiment in the direction of a marked X-axis. Three adjacent, essentially closed housing parts 54, 55, 56 extend in the direction of a marked Y-axis. Two of the closed housing parts 54 and 56 are connected to each other by two struts 57, 58, which characterize the cage-like structure of housing 5. One strut 58 lies between housing openings 51 and 52. The other strut 57 extends between housing openings 52 and 53.

As a cross section of struts 57, 58 shows (see FIGS. 3-5) the struts 57, 58 have two steps 57*a*, 57*b*, 58*a*, 58*b*. Each strut has several longitudinal edges. Each strut 57, 58 also represents a longitudinal edge of the housing 5. More precisely stated, the longitudinal edge of housing 5 is formed by such an outer longitudinal edge of strut 57, 58 in which none of the mentioned steps is present.

Figure 2:
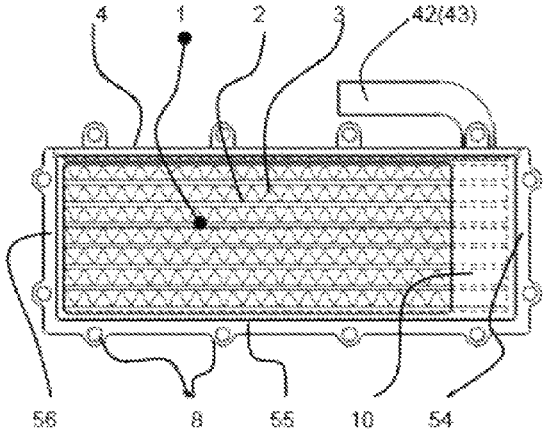
FIG. 2 shows a longitudinal schematic section through the heat exchanger in its housing.

The middle housing opening 52 represents an insertion opening for a brazed stack 1 of tubes and fins 3, which forms the heat exchanger core (FIG. 2). The illustrated tubes are formed from pairs of plates 2. Stack 1 has a cover plate 4. The illustrated cover plate 4 has a continuous edge 41 (FIG. 5) extending over stack 1. The illustrated continuous edge 41 is fastened all the way around to a continuous edge of insertion opening 52 and completely closes off insertion opening 52.

More precisely stated, the edge 41 of cover plate 4 with one edge side 41 is fastened to one strut 57 and with its roughly parallel other edge side 41 to the other strut 58. Even more precisely stated, fastening occurs in the step 57*b* of one strut 57 and the step 58*a* of the other strut 58. As shown in FIG. 1, the two other edges of insertion opening 52 are also provided with a corresponding edge step so that a perfect seat is provided for the entire continuous edge 41 of cover plate 4 (reference number b1), which lies in a common plane. In one embodiment the fastening type here includes a weld (not shown), which is made all the way around the entire edge 41.

As also shown in the figures the steps 57*b* and 58*a* lie in the plane of the insertion opening 52. The other steps 57*a* and 58*b*, on the other hand, lie in the planes of the first and third housing openings 51, 53 in which different collection boxes 6, 7 can be fastened in a variety of ways.

Figure 3:
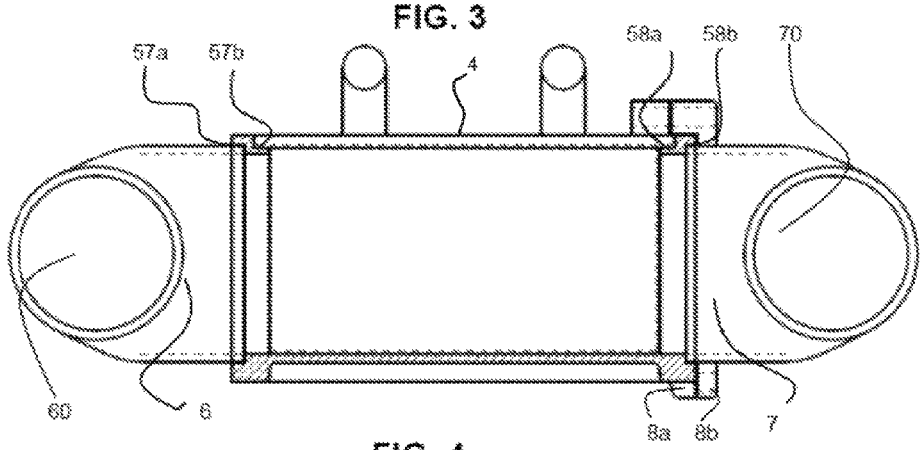
FIG. 3 shows a welded-on collection box and with a mechanically-connected collection box according to some embodiments of the present invention.

According to FIG. 3 the collection box 7 on the right side is a plastic box 7 that sits in the first housing opening 51. It has some fastening eyes 8*b* distributed on its edge, which correspond to other fastening eyes 8*a* arranged on the cover plate 4 and on housing 5 (FIG. 2). Seals or the like are present in the embodiment but are not apparent from the drawings.

The left collection box 6 can be a metallic collection box, which sits in the third housing opening 53 and is completely welded to the edge of this housing opening 53 in the illustrated embodiment of FIG. 3. The mentioned step 57*a* of strut 57 as well as the left and right edges and the lower edge of housing opening 53 readily visible in FIG. 1 pertain to the edge of this housing opening 53. These edges are also provided with a step (reference number a1), which lies in a common plane with step 57*a* so that a perfect seat is also offered to the continuous edge of the collection box 6.

The illustrated plastic box 7 has an outlet opening 70, which is connected to the inlet of a not depicted but relatively small intake tube of an internal combustion engine. The illustrated inlet opening 60 of the left collection box 6 is connected to the output of an also not depicted compressor at least when charge air is also to be cooled. Exhaust being cooled can also be supplied here.

Figure 4:
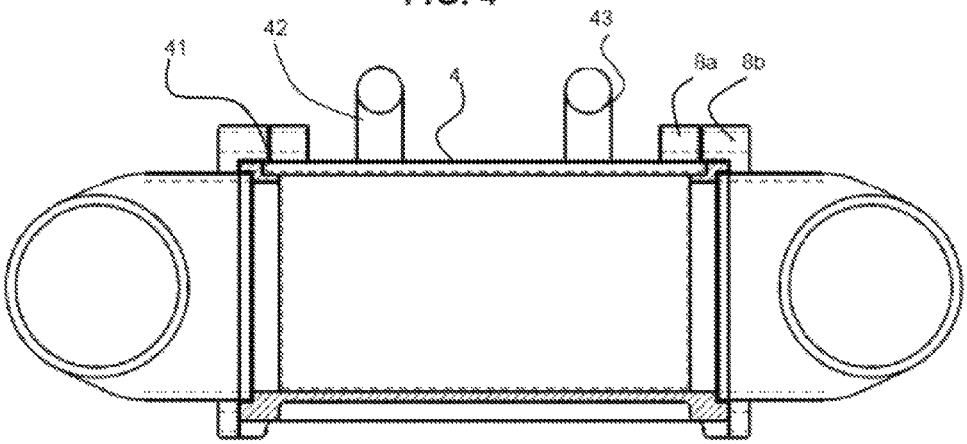
FIG. 4 shows two mechanically-connected collection boxes.

The embodiment according to FIG. 4 has two collection boxes 6 and 7, which are mechanically fastened, as described under FIG. 3. These can be two plastic boxes.

Figure 5:
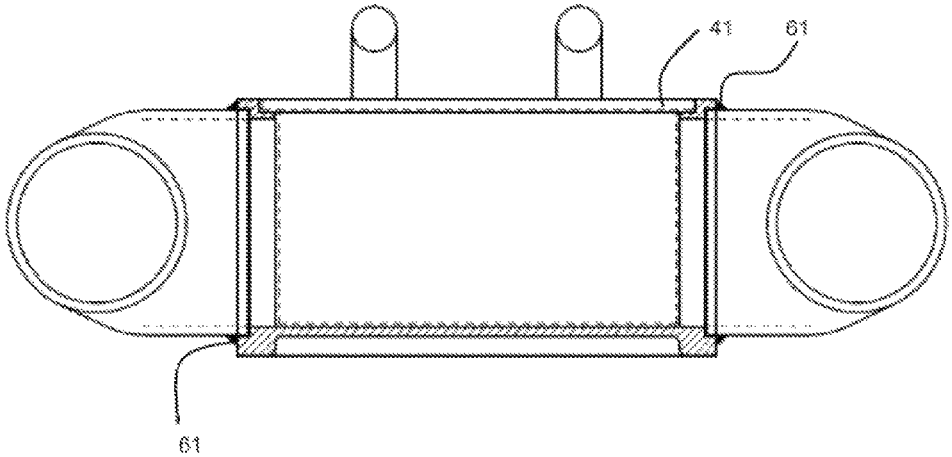
FIG. 5 shows two welded-on collection boxes.

In contrast to this, two metallic collection boxes 6 and 7 are welded in FIG. 5. Welds are indicated and provided with the reference number 61.

As is also readily apparent from FIGS. 1 and 2, the first and third housing openings 51, 53 in the illustrated embodiment are somewhat smaller than the second middle housing opening 52. A partial housing wall 50 was provided in the first and third housing side, which makes the corresponding housing openings 51, 53 smaller. This feature is consistent with the design and arrangement of stack 1, which forms the already described heat exchanger core.

The plates 2 of stack 1 have two protrusions on the right edge side, in each of which there is an opening (not apparent). Other plate designs have no protrusions but also the two openings on a common edge side.

The openings in stack 1 of pairs of plates 2 lie vertically one above the other and form an inlet channel and an outlet channel for a coolant, which can flow in the paths of plates 2. For this purpose a coolant inlet 42 and a coolant outlet 43 are situated on the cover plate 4, which are hydraulically connected to openings, which are not visible. Since the coolant inlet 42 and the coolant outlet 43 are arranged on a common plate side, the plates 2 must be designed so that a U-shaped flow can occur within the pair (also not shown).

The gas, such as exhaust and/or charge air, flows through the fins 3 of stack 1, entering one of the collection boxes 6, is cooled in the heat exchanger core and emerges through the other collection box 7.

Since effective heat exchange cannot occur between the mentioned two protrusions or openings of plates 2, which represent an inlet and outlet area 10 of the heat exchanger core, the aforementioned partial housing walls 50 make sure that the gas is concentrated on that part of the heat exchanger core in which the fins 3 are situated. The partial housing walls 50 therefore cover the inlet and outlet area 10 and suppress flow on the gas side in order to improve the efficiency of the heat exchanger.

What is claimed is:

1. A heat exchanger comprising:

at least one stack of tubes with fins arranged in between the tubes;

a cover plate extending over the at least one stack of tubes and coupled to the at least one stack of tubes, the cover plate including a first side and a second side parallel to the first side; and a housing, the at least one stack arranged in the housing, the housing comprising:

first, second, and third adjacent housing sides including a respective first, second, and third housing openings each having an edge around the respective housing opening, wherein the second housing opening is a middle housing opening between the first and the third housing openings and is an insertion opening for the at least one stack of tubes, wherein the middle housing opening is closed by a continous edge of the cover plate on the edge of the middle housing opening;

fourth, fifth, and sixth adjacent closed housing sides; and first and second exposed struts, wherein the first exposed strut is positioned between the first and the middle housing openings and the second exposed strut is positioned between the middle and the third housing openings, wherein the first side of the cover plate is fastened to the first exposed strut and the second side of the cover plate is fasted to the second exposed strut, and wherein the first and second exposed struts each have a generally Z-shaped cross section with first and second steps.

2. The heat exchanger of claim 1, further comprising a first collection box having an edge section that lies on the first exposed strut to close the first housing opening.

3. The heat exchanger of claim 2, further comprising a second collection box having an edge section that lies on the second exposed strut to close the second housing opening.

4. The heat exchanger of claim 3, wherein the first collection box is an inlet collection box that is welded onto the edge of the first housing opening.

5. The heat exchanger of claim 4, wherein the first collection box is formed from an aluminum casting.

6. The heat exchanger of claim 4, wherein the first collection box is formed from sheet metal.

7. The heat exchanger of claim 3, wherein the second collection box is an outlet collection box that is made as an injection molding from plastic and is fastened mechanically to the edge of the third housing opening.

8. The heat exchanger of claim 1, wherein the first step of the cross section of the first and second exposed struts each defines a portion of the edge of the middle housing opening, the second step of the first exposed strut defines a portion of the edge of the first housing opening, and the second step of the second exposed strut defines a portion of the edge of the third housing opening.

9. The heat exchanger of claim 1, wherein the first exposed strut represents a first longitudinal edge of the housing and the second exposed strut represents a second longitudinal edge of the housing.

10. The heat exchanger of claim 3, wherein the cover plate includes fastening eyes that correspond to fastening eyes of at least one of the first and second collection boxes.

11. The heat exchanger of claim 10, wherein the fastening eyes of the cover plate are brazed onto the cover plate, and the fastening eyes of the at least one of the first and second collection boxes are integrally formed as a single unitary piece with said collection box.

12. The heat exchanger of claim 1, wherein the edge of the cover plate is fastened to the edge of the middle housing opening.

13. The heat exchanger of claim 12, wherein the edge of the cover plate is welded to the edge of the middle housing opening.

14. The heat exchanger of claim 1, wherein the second housing side has an area, and wherein the middle housing opening has an area that is approximately the area of the second housing side.

15. The heat exchanger of claim 1, wherein the first and third housing openings are the same size and wherein the middle housing opening is larger than each of the first and third housing openings.

16. The heat exchanger of claim 1, wherein the first housing side in which the first housing opening is located further includes a first partial housing wall, and wherein the position and extent of the first partial housing wall correspond with an inlet area for coolant in the stack of plates and fins.

17. The heat exchanger of claim 1, wherein the at least one stack of tubes includes pairs of plates.

18. The heat exchanger of claim 1, wherein the housing has a one-piece, cage-like cast structure.

19. A heat exchanger comprising:

at least one stack of tubes with fins arranged in between the tubes;

cover plate extending over the at least one stack of tubes and coupled to the at least one stack of tubes, the cover plate including a first side and a second side parallel to the first side;

a housing, the at least one stack arranged in the housing, the housing comprising:

first, second, and third adjacent housing sides including a respective first, second, and third housing openings each having an edge around the respective housing opening, wherein the second housing opening is a middle housing opening between the first and the third housing openings and is an insertion opening for the at least one stack of tubes, wherein the middle housing opening is closed by a continuous edge of the cover plate on a middle opening seat of the middle housing opening, wherein the first housing opening includes a first opening seat, and wherein the third housing opening includes a third opening seat;

fourth, fifth, and sixth adjacent generally closed housing sides; and first and second exposed struts, wherein the first exposed strut is positioned between the first and the middle housing openings and the second exposed strut is positioned between the middle and the third housing openings;

a first collection box located at least partially within the housing in the first housing side; and a second collection box located at least partially within the housing in the third housing side, wherein the continuous edge of the cover plate lies in a common plane, wherein the middle opening seat is defined by a first step of the first strut, a second step of the second strut, and middle opening steps of two other edges of the middle opening, wherein the continuous edge of the cover plate is seated on the middle opening seat of the middle housing opening, wherein the first opening seat is defined by steps of edges of the first opening, the steps being in a common plane, wherein the third opening seat is defined by steps of edges of the third opening, the steps being in a common plane, wherein the first collection box includes a continuous edge that is seated on the first opening seat, and wherein the second collection box includes a continuous edge that is seated on the third opening seat.

20. A heat exchanger comprising:

at least one stack of tubes including fins arranged in between the tubes, an inlet channel, and an outlet channel, wherein the inlet and outlet channels are arranged on the same side of the stack;

a cover plate extending over the at least one stack of tubes and coupled to the at least one stack of tubes; and a housing, the at least one stack arranged in the housing, the housing comprising:

first, second, and third adjacent housing sides including a respective first, second, and third housing openings each having an edge around the respective housing opening, wherein the second housing opening is a middle housing opening between the first and the third housing openings and is an insertion opening for the at least one stack of tubes, wherein the middle housing opening is closed by a continuous edge of the cover plate on the edge of the middle housing opening, wherein the first side includes a first partial housing wall, and wherein the third side includes a second partial housing wall; and fourth, fifth, and sixth adjacent generally closed housing sides, wherein the first and second partial housing walls cover the inlet and outlet channels of the at least one stack.

* * * * *